United States Patent [19]

Camp

[11] 4,404,695

[45] Sep. 20, 1983

[54] AUTOMATIC-LOCKING TOILET SEAT LID

[76] Inventor: Howard C. Camp, P.O. Box 2072, Huntsville, Ala. 35804

[21] Appl. No.: 330,682

[22] Filed: Dec. 14, 1981

[51] Int. Cl.[3] ..... A47K 13/00; A47K 13/26

[52] U.S. Cl. ..... 4/253; 4/236; 292/4

[58] Field of Search ..... 4/234–240, 4/253; 16/292, 297, 348; 292/4

[56] References Cited

U.S. PATENT DOCUMENTS

| | | | |
|---|---|---|---|
| 1,737,891 | 12/1929 | Parkins | 292/4 |
| 2,431,263 | 11/1947 | Lundgren | 4/236 |
| 2,578,153 | 6/1951 | Schitz | 4/236 |

*Primary Examiner*—Stephen Marcus

*Assistant Examiner*—Kenneth S. Putnam

[57] ABSTRACT

A conventional shaped, generally oval, toilet seat assembly having a toilet seat lid with an aft extension which houses a spring-latch bolt mechanism and a common axle which serves to hold the lid, and toilet seat, and the companion anchor bolt lock-block assemblies and hinges together. A single removable compression spring exerts a constant outward pressure on the latch bolts in the lid extension which interface with and are forced against the inside surface of the companion anchor bolt lock-blocks. When the lid is moved to the horizontal (down) position the latch bolts are aligned with and automatically extend from the lid into the matching latch bolt holes in the anchor bolt lock-bolt assembly. The lid and seat remain in the down and locked position until the latch bolts are retracted.

5 Claims, 4 Drawing Figures

AUTOMATIC-LOCKING TOILET SEAT LID

BACKGROUND OF THE INVENTION

This invention relates to a practical, economically produced, and reliable toilet seat lid which automatically locks in the closed/down position and is conceived as a safety device to deter toddlers and very young children from falling into or throwing toys and other large objects into toilet basins. The inventor is the purchaser and assignee of the Toilet Seat and Lid Safety Lock invented by Tracey L. Foster and patent applied for on Nov. 4, 1981. This invention is a natural follow-on to that invention and incorporates the same spring-latch principle which automatically locks the toilet seat lid when it is lowered to the down or horizontal position. The aforementioned Toilet Seat and Lid Safety Lock is designed to be used as a locking device which is separate from and must be installed on existing toilet seat assemblies; wherein this invention, while having the same objectives, has the automatic spring-latch locking mechanism incorporated into the toilet seat lid and the latch (bolt) interface mechanism incorporated in the anchor bolt and hinge assembly at the time of the manufacture. With such a device being unknown to the inventor, he conceived and developed the Automatic-Locking Toilet Seat Lid.

The automatic locking lid and toilet seat assembly is designed as a reliable and economically produced toilet seat and lid assembly with a built-in automatic safety lock mechanism. Simple installation is required. Another requirement is that it have sufficient strength and durability to withstand the pull of a small child and the unlocking mechanism must provide ease of operation for an older child or adult while having a degree of difficulty sufficient to deter a toddler or small child from activating the release.

SUMMARY OF THE INVENTION

In the present invention is a toilet seat and lid and anchor bolt assembly in which the lid rotates (raises and lowers) about a transverse axle (rod) which passes through the lid and which is held in position by extending on each side through an anchor bolt assembly. The lid extends behind the axle (point of rotation) a sufficient distance to accommodate a hole containing the spring-latch locking mechanism which is transverse to the lid centerline and parallel to the axle (rod). The hole containing the spring latch mechanism is near the aft extremity of the lid. The spring-latch mechanism consists of two latches (bolts) with a compression spring between them in the center of the hole. The single spring exerts an equal constant outward force on each of the two (2) bolts and holds the bolts (and the lid) in the locked position when the lid is in the horizontal or down position by forcing them into recesses in the anchor bolt assemblies which interface with the aft extension of the lid and which match the hole containing the latching bolts. When the lid is raised the latching bolts are forced against and ride on the inside flat surface of the anchor bolt assembly which consists of a rectangular block with an anchor bolt extending from its bottom, a hole through which the lid axle (rod) passes and a recess on the inside to receive the latching bolts when the lid is in the down position. The hole which accommodates the axle (rod) must be of sufficient height from its base to allow the lid to be rotated to the full up position without the aft extension of the lid striking the surface of the toilet basin. Unlatching the lid is accomplished by squeezing together two (2) stud grips which are positioned on top of the aft extension of the lid. This is accomplished by passing the studs through slots in the lid and into the tops of the latching bolts. The length of the slots restrain and control the amount of bolt extension into the interfacing anchor bolt assembly. Additionally, because there are two (2) separate slots (one for each bolt), when either stud reaches its limit the squeezing action will assure that both bolts are retracted. The two (2) stud grips are sufficiently far apart and the spring tension such that they can be easily squeezed together by an adult or older child, but very difficult, if not impossible, for a toddler or small child. The seat is attached to the assembly by a pair of conventional-type hinges which slip on and cap the ends of the axle (rod) which runs through the lid and both anchor bolt assemblies. The rear of the seat rests on the "L" shaped hinge which is suspended from the axle. The seat hinges are attached to the bottom of the seat and are therefore prevented from sliding laterally off the ends of the axle. The rear of the seat is slightly indented to allow the rear lid extrusion clearance of the rear of the seat when the lid is rotated up past the 90° position; i.e., lean back against the toilet tank.

The entire toilet seat, lid, lock and anchor bolt assemblies will normally be fully assembled at the manufacturer and will be ready for installation by the consumer on most standard toilet bowls (commodes) simply by inserting the anchor bolts through the holes in the toilet bowls and putting on and tightening the two (2) nuts. Provision is also made whereby the squeeze spring-latch lock may be held in the unlatched mode thus allowing full and free operation of the lid the same as with other conventional toilet seat lids or it can easily and quickly be put in the automatic locking mode. This can be accomplished by squeezing the latch-bolt studs together and rotating them forward into slotted detents which are set at angles slightly more than 90° degrees to the latching bolt stud slots. Spring pressure holds the studs in the detents (unlatched position).

The design of the Automatic-Locking Toilet Seat Lid is extremely simple and such that a minimum amount of tooling, machining and assembly time is required in its manufacture and production; thus allowing an economical way to provide the consumer with a highly functional toilet seat assembly with a built-in, automatic locking lid which provides a high degree of safety and reduced probablity of excessive plumbing bills in households where toddlers and small children frequent. The entire assembly can be manufactured from a variety of available plastics, wood, wood products, or combinations thereof. The axle (rod) and the latch bolts can be made from plastics or metal.

It is therefore the object of this invention to provide a toilet seat and lid assembly with a lid which incorporates an automatic safety locking mechanism to prevent toddlers and small children from accidentally falling into toilet basins and drowning.

Yet another object is to provide a toilet seat lid which will deter small children from throwing toys or other large objects into toilet basins and otherwise causing damage and often expensive plumbing and maintenance costs.

Yet another object is to provide a toilet seat lid which automatically relocks without any conscious effort of a user and which is easy for an adult or older child to unlock and raise, but extremely difficult for a toddler or very young child to unlock and raise.

Yet another object is to provide a toilet seat and lid assembly that has the versatility to be used in the automatic locking safety mode or in the unlocked and free swinging conventional mode.

Yet another object is to provide a toilet seat lid with an internal locking mechanism which is economically affordable and which is easy to install.

Other objects and advantages of the invention will be apparent from the following detailed description and the appended claims.

DESCRIPTION OF THE PREFERRED EMBODIMENT

Figure 1:
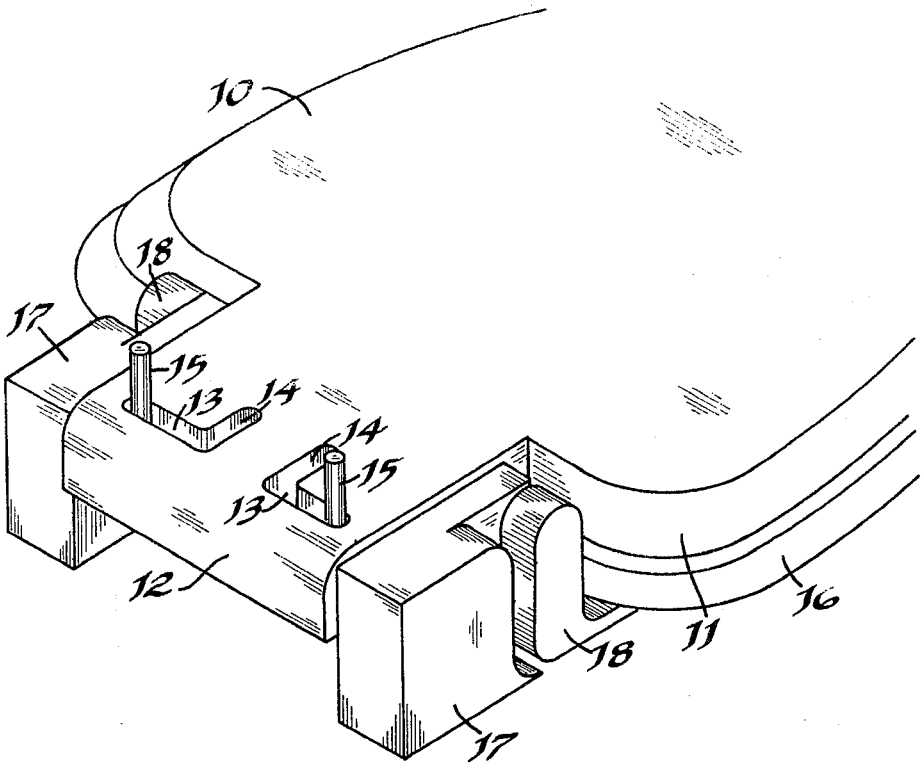
FIG. 1 is an isometric view showing the automatic locking lid and toilet seat assembly as installed on a toilet basin.
Figure 2:
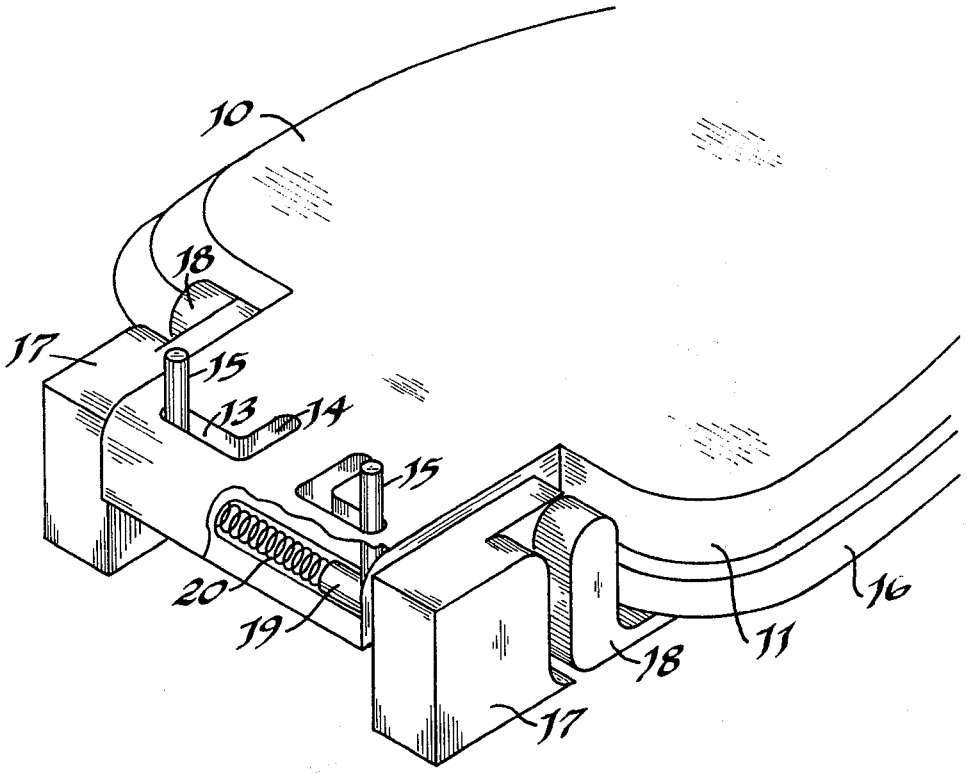
FIG. 2 is an isometric view showing the automatic locking lid and toilet seat assembly with a cutaway depicting the spring latchbolt mechanism in the aft extension of the lid.
Figure 3:
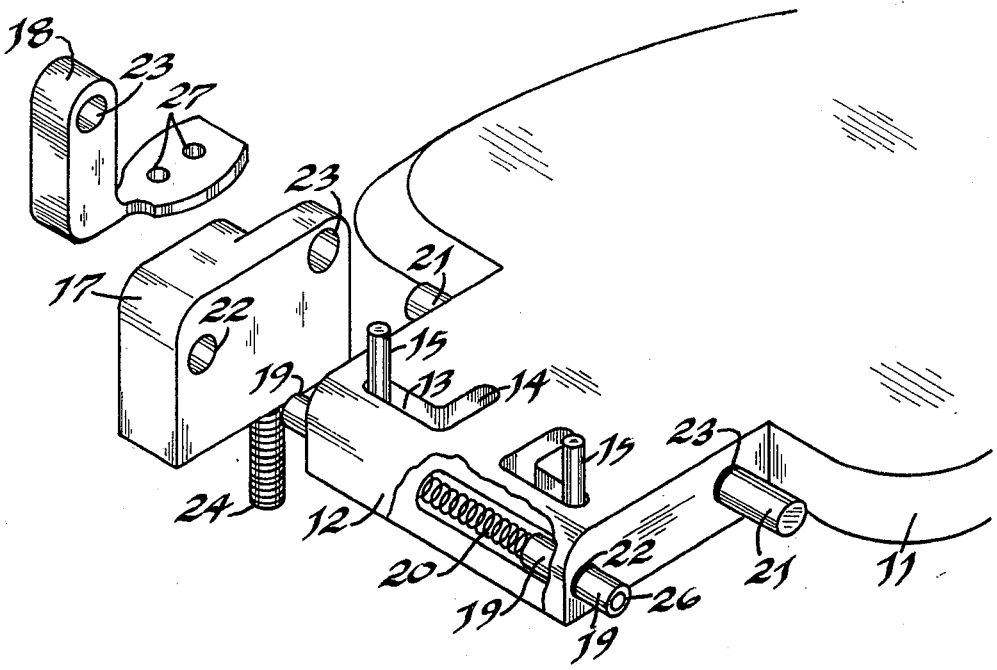
FIG. 3 is an isometric exploded view showing the relationship of the lid and latch to the anchor bolt lock-block assembly and the toilet seat hinge and depicting the spring latch bolt mechanism with squeeze studs, the beveled ends of the latch-bolts, the latch-bolt stud slots and unlock detents, the lid axle rod about which the lid and seat hinge rotates, the latch-bolt recess in the anchor bolt (lock-block) assembly, the holes through the anchor bolt assembly and the seat hinge to accommodate the lid axle rod, and the anchor bolt extending from the anchor bolt lock-block assembly.
Figure 4:
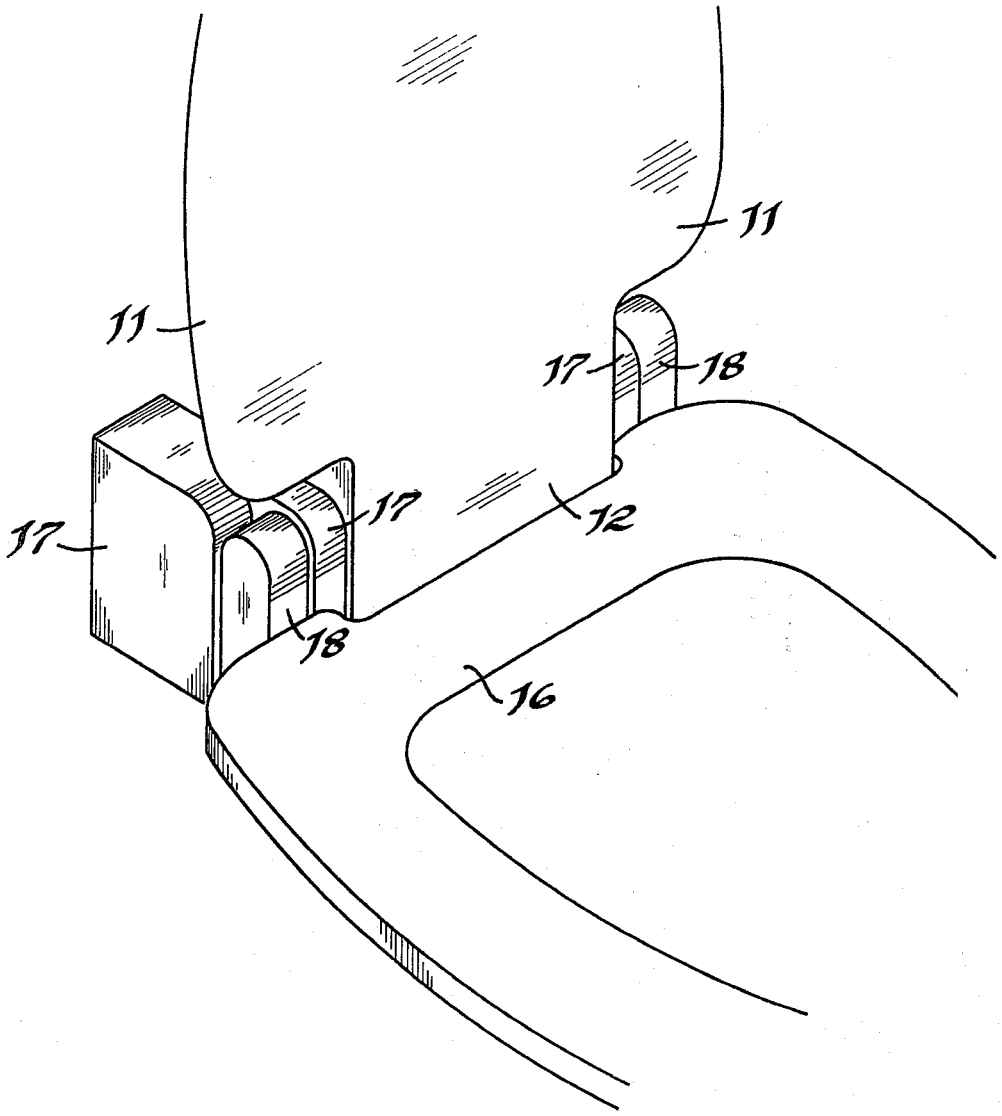
FIG. 4 is an isometric view showing the completed automatic locking lid and toilet seat assembly with the lid fully up past the 90° degree (vertical) position and depicting the indentation in the back of the seat to accommodate the aft extension of the lid when the lid is in the full "up" position.

Referring now to FIGS. 1 through 4 in the drawings, an automatic locking lid and toilet seat assembly is indicated generally by the numeral 10. The spring latch-bolt mechanism is housed in the aft extension of the toilet seat lid 12 and consists of two cylindrical latch-bolts 19 which slide laterally in a hole 23 which runs transversly through the lid extension 12. The latch-bolts are separated by a single spring 20 which exerts a constant outward lateral force against the bolts. The lid and the anchor bolt lock-block assembly are held together by a common axle 21 which runs transversely through holes 23 through the lid extension 12, the anchor bolt lock-block 17, and the seat hinges 18. The seat hinges 18 hold the assembly together and are prevented from sliding laterally off the ends of the axle by attaching the hinges 18 to the bottom of the toilet seat 16 by screws through the pilot holes 27 in the seat hinges. The aft extension of the lid 12 interfaces with the inside faces of the anchor bolt lock-block assemblies 17 and when the lid is in the down or horizontal position the spring 20 forces the latch-bolts into the recessed holes 22 in the inside surfaces of the anchor bolt lock-block assemblies. When the lid is being raised or lowered the spring continues to exert an outward force on the latch bolts which ride in an arc against the inside surfaces of the anchor bolt lock-block assemblies. When the lid reaches the horizontal or down position the beveled latch bolts 26 automatically slide into the latch-bolt recessed holes 22 in the anchor bolt lock-block assemblies 17 locking the lid in the down position. The entire assembly is secured to the toilet basin (bowl) by inserting the two anchor bolts 24 through the anchor bolt holes in the basin and tightening the anchor bolt nuts from beneath the toilet basin.

The latch-bolts are retracted to allow the lid (and seat) to be raised by squeezing the two latch-bolt grip studs 15 together. The grip studs are inserted in the tops of the latch-bolts 19 and extend through slots 13 on the top of the aft lid extension 12. The latch-bolts are held in the hole 22 through the lid extension 12 by the latch-bolt grip studs 15 reaching the limits of the stud slots 13. The amount of latch-bolt extension and retraction is determined by the length of the stud slots 13.

The automatic locking mechanism is held in the unlatched mode by squeezing the latch-bolt stud grips 15 together and rotating them forward into the locking detents 14 which hold the latch-bolts in the retracted position. The locking detents 14 are "L" shaped slot extensions of the stud grip slots 13 which are set slightly more than 90 degrees to slots 13 and the constant outward pressure of the spring 20 holds the sutds (and bolts) in the detents 14. The locking mechanism is put back in the "automatic" locking mode by rotating the squeeze grip studs 15 backwards to the upright position into the transverse slots 13 and the spring 20 again forces the latch bolts 19 against the inside of the anchor bolt lock-block assemblies 17.

It is to be understood that the automatic-locking toilet seat lid and assembly described in detail above is given only as exemplary and that various changes and modifications thereof can be employed without departing from the scope of the invention.

I claim:

1. An automatic-locking toilet seat assembly comprising:

(a) a toilet seat lid with a centerline and an aft extension unitary with said toilet seat lid, designed to accommodate a first cylindrical hole and a second cylindrical hole said holes running transverse to the lid centerline, and parallel to each other, wherein said first cylindrical hole is forward of said second cylindrical hole and accommodates an axle rod, said second cylindrical hole housing a latch bolt assembly comprised of two sliding latch bolts which are separated by a compression spring and extend outward through opposite ends of said second cylindrical hole said axle being positioned so as to be a pivot about which said latch bolt assembly and said toilet seat lid may rotate;

(b) a pair of anchor bolt lock-block and hinge assemblies; each of said anchor bolt lock-block and hinge assemblies having a pair of indents, said pair of indents being comprised of a forward indent and a rear indent, said forward indents being positioned to receive and hold said axle rod at its ends, said rear indents being simultaneously positioned to receive the extended portions of said sliding latch bolts when said toilet seat lid is in a down position, said sliding latch bolts being controlled by a pair of studs which extend out through a pair of L-shaped slots in said aft extension of said toilet seat lid, said L-shaped slots allowing said studs to be hooked back into a position where said sliding latch bolts are removed from said rear indents permitting said toilet seat lid to rotate freely, said studs and said sliding latch bolts being operable in an automatic locking mode when said studs are not hooked.

2. The invention as defined in claim 1 wherein said automatic locking toilet seat assembly is made of plastic.

3. The invention as defined in claim 1 wherein said automatic locking toilet seat assembly is made of hardwood.

4. The invention as defined in claim 1 wherein said automatic locking toiletseat assembly is made of a combination of hardwood plastic and metal.

5. The invention of claim 1 wherein said compression spring is removable.

* * * * *